US008710340B2

(12) United States Patent
Barron

(10) Patent No.: US 8,710,340 B2
(45) Date of Patent: Apr. 29, 2014

(54) STRING CHANGING TOOL WITH A QUICK CONNECTOR ASSEMBLY AND WORM GEAR STRING CUTTER

(76) Inventor: Drew Anthony Barron, Greenford (GB)

( * ) Notice: Subject to any disclaimer, the term of this patent is extended or adjusted under 35 U.S.C. 154(b) by 0 days.

(21) Appl. No.: 12/780,983

(22) Filed: May 17, 2010

(65) Prior Publication Data

US 2011/0017047 A1 Jan. 27, 2011

Related U.S. Application Data

(60) Provisional application No. 61/271,670, filed on Jul. 23, 2009.

(51) Int. Cl.
*G10D 3/14* (2006.01)

(52) U.S. Cl.
USPC ..... 84/312 R

(58) Field of Classification Search
USPC ..... 84/312 R, 453, 454, 458
See application file for complete search history.

(56) References Cited

U.S. PATENT DOCUMENTS 5,689,076 A * 11/1997 Usuda ..... 84/458
6,255,575 B1 * 7/2001 Pearse ..... 84/458

* cited by examiner

*Primary Examiner* — Kimberly Lockett

(57) ABSTRACT

A string changing device is disclosed. The device comprises an elongated socket that surrounds the tuner button of the instrument. A lever extends from the socket and is attached to a handle. The handle and lever combine as a crank to tension the strings to approximate pitch. The handle has a worm-gear cutter embodied within it. The handle is attached to the lever with a rotatable hinge that enables the handle to function as a winder when aligned axially. It also prevents the cutter body from turning during the cutting operation when aligned off axis. The quick release assembly is mounted on the lever in the preferred embodiment and is removed during winding and cutting operations.

5 Claims, 2 Drawing Sheets

STRING CHANGING TOOL WITH A QUICK CONNECTOR ASSEMBLY AND WORM GEAR STRING CUTTER

CROSS-REFERENCE TO RELATED APPLICATIONS

Provisional application 61/271,670 filed Jul. 23, 2009

FEDERALLY SPONSORED RESEARCH

Not applicable.

SEQUENCE LISTING OR PROGRAM

Not applicable.

FIELD OF INVENTION

This invention relates to the tools used to facilitate changing strings on guitars and other stringed instruments. The invention relates to an improvement to such a tool of a quick connection/release keyring. The improvement also includes a string cutter formed in the handle of the tool.

BACKGROUND OF THE INVENTION

For many years crank-type tools have been available to enable one to tighten or loosen the strings of a guitar. Such tools have included handles which are rotatable relative to the arm, the remote end of which is provided with a socket to receive and grip the tuner button of a guitar by the turning of which each string may be tightened or loosened. These tools have a notch in the void for the extraction of bridge pins. A string shearing device is incorporated into the handle of the crank. Musicians often have many instruments. A musician may bring a different instrument to a different job. Typically, the user would need to have a separate tool for each instrument and store it in the instrument case or transfer the tool as necessary from instrument to instrument. To ensure that the tool is always with the user, the quick release keyring provides means and use.

DISCUSSION OF PRIOR ART

Morin in U.S. Pat. No. 3,706,254 and Longone & Celeste in U.S. Pat. No. 2,812,682 claim a crank with a handle. These cranks made of plastic and wood were designed to rest in the instrument case when not in use. Pearse in U.S. Pat. No. 6,255,575 and Pantoja in U.S. Pat. No. 5,505,116 show a crank with a cutter in the handle. Although having a cutter in the handle is desirable, both of these are large and bulky so they must be stored in the case when not in use. There is also no other reason to carry the tool with the user at all times. Secord in U.S. Pat. No. 4,970,930 shows a worm gear style string cutter that mounts directly onto the instrument. Typically, this would be six cutters per standard guitar and may require modification to the instrument. Takegawa in U.S. Pat. No. 7,371,955 shows a removable key ring attached to a drum key.

OBJECTS AND ADVANTAGES

The object of this invention is to provide a tool for changing instrument strings that has the advantage of increased portability and use. The advantage of a key fob that attaches to the tool provides an additional use for the tool and gives a reason to keep it with you. The user needs to have only one tool for all of their stringed instruments because the tool is always with the user. The increased portability of this tool allows users to carry it hooked onto a belt for easy access. This is especially useful for roadies and technicians who often carry a selection of tools on belts. The object of the rotatable hinge is to hold the cutter body during the cutting operation and prevent it from turning but also allowing it to freely rotate during the winding operation. This advantage overcomes prior art that showed each cutter assembly mounted directly to the instrument.

SUMMARY

The invention is a multi-function string changing tool that enables the user to wind tuning pegs rapidly. It also has a pin extractor for removing bridge pins from steel string acoustic guitars. It also features a worm gear style string cutter in the handle. The tool has a key ring that is of the quick connect/release, removable type.

A BRIEF DESCRIPTION OF THE DRAWINGS

DETAILED DESCRIPTION OF THE PREFERRED EMBODIMENT

Figure 2:
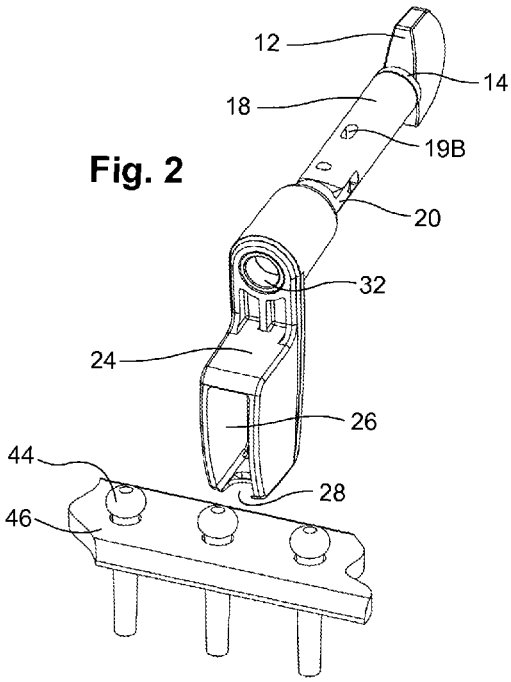
FIG. 2 shows the tool in the bridge pin removal position
Figure 3:
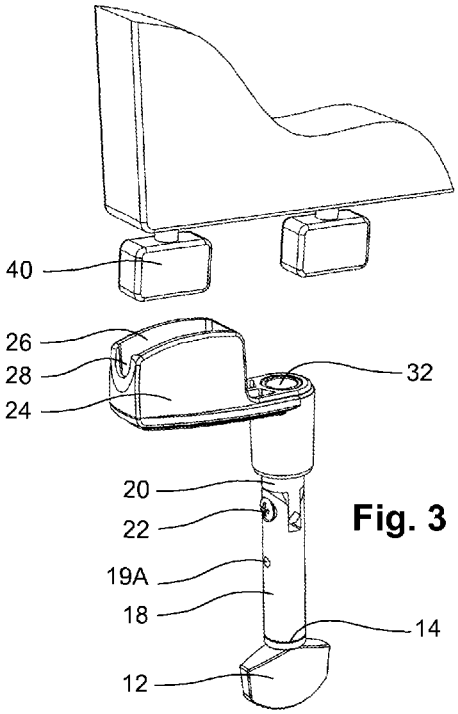
FIG. 3 shows the tool in the string winding position

The preferred embodiment as in FIG. 3 shows a lever 24 with an elongated socket 26 that fits over tuner button 40. FIG. 2 shows the remote end of the lever 24 has a slot 28 that enables the user to pry the pin 44 from the bridge 46.

The Quick Release Key Ring

Figure 1:
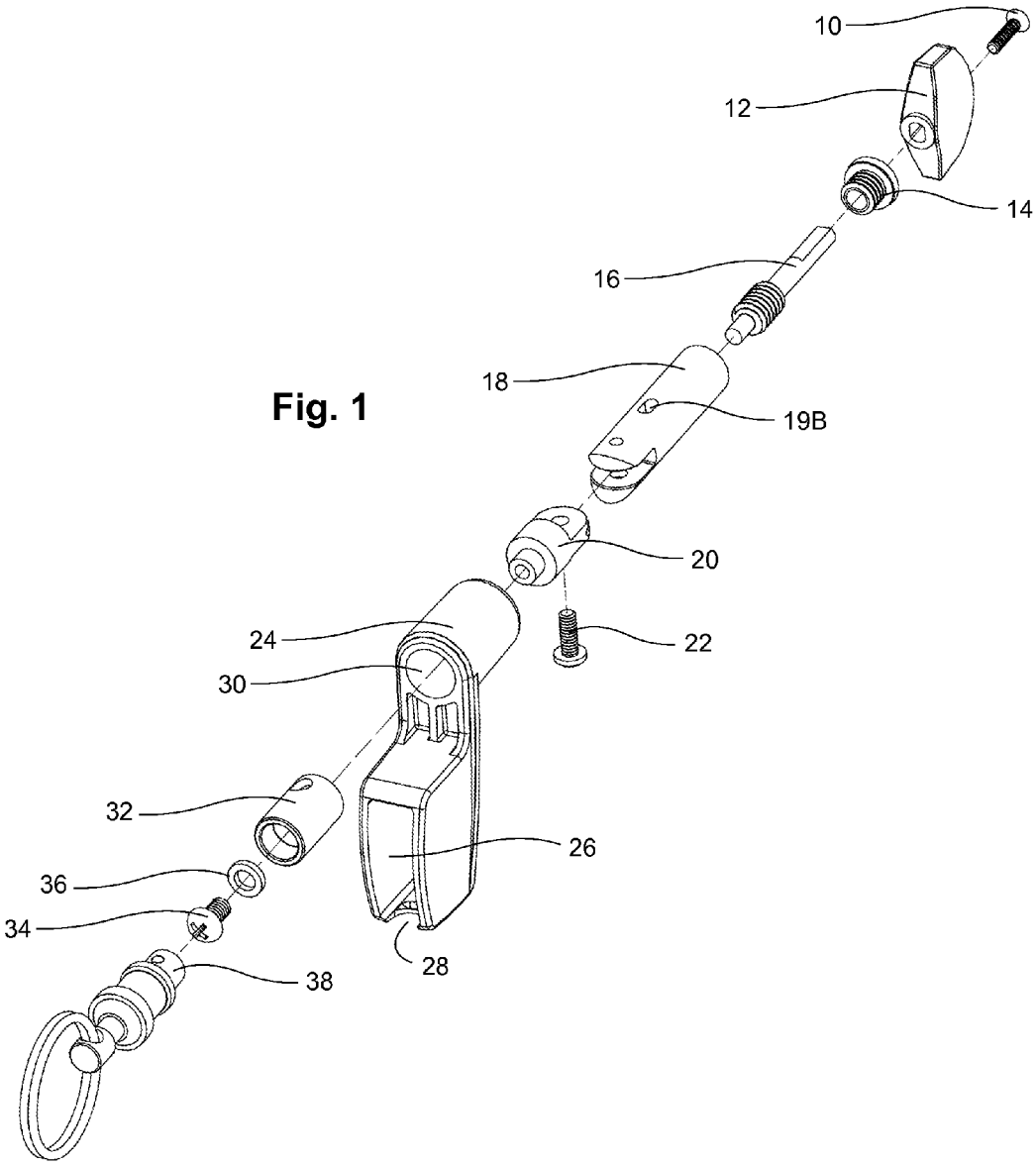
FIG. 1 shows an exploded perspective view of the invention.

FIG. 1 shows the lever 24 has a cavity 30 sized to fit a quick release barrel 32. The barrel 32 is press fitted into the cavity 30. A quick release plunger 38 is inserted into the barrel 32 and locks in place.

The String Cutter Handle

FIG. 1 shows the string cutter handle is comprised primarily of a bored and threaded cylindrical body 18, a threaded cutting stem 16 and a rotatable hinge 20. FIG. 1 shows the bored and threaded cylindrical body 18 attaches to a rotatable hinge 20. The rotatable hinge 20 attaches to the lever 24. The cutting stem 16 inserts into the bored and threaded cylindrical body 18. Turning of the cutting stem 16 is aided by a knob 12. The cutting stem 16 is prevented from retraction by a plug 14.

Figure 4:
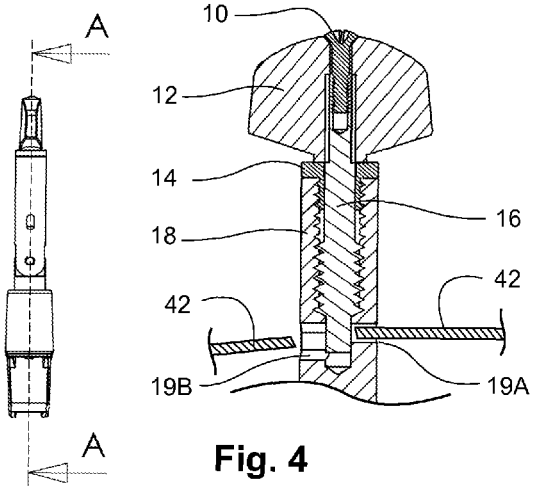
FIG. 4 shows a cross section of the cutting position of the shaft and stem

FIG. 4 shows that the bored and threaded cylindrical body 18 has holes 19A and 19B.

Figure 5:
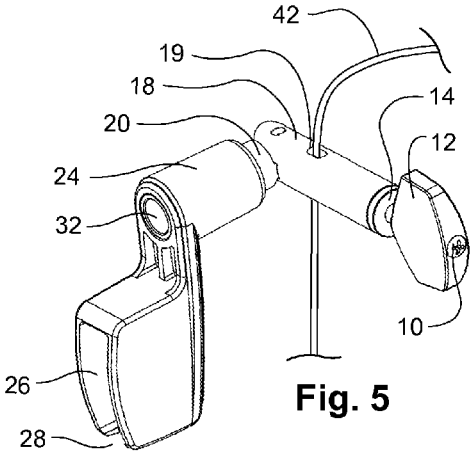
FIG. 5 shows the tool in the string cutting position

FIG. 5 shows the cutter handle turned off axis from the winding position. This is performed by using the rotatable hinge 20.

DETAILED DESCRIPTION OF THE OPERATION

The key ring quick release plunger 38 is removed during tool operations for ease of use.

FIG. 2 shows a slot 28 and how it is used to pry a pin 44 from a guitar bridge 46.

FIG. 3 shows the tool in a position that allows the rotatable hinge 20 and the bored and threaded cylindrical body 18 when aligned axially to perform as a handle for the lever 24. The elongated socket 26 is placed over the tuner button 40. The user grips the handle formed by the bored and threaded cylindrical body 18 and rotatable hinge 20 and cranks the tuner button 40 to approximate pitch.

FIG. 5 shows the tool in a string cutting position. The bored and threaded cylindrical body 18 is hinged off axis to prevent turning of the bored and threaded cylindrical body 18 during the cutting operation. FIG. 4 shows that the string 42 passes through the holes 19A and 19B. The cutting stem 16 is advanced manually into the bored and threaded cylindrical body 18 by turning the knob 12. The stem 16 shears the string 42 at the bottom of hole 19A. The enlarged hole 19B allows the severed string to be removed easily.

DESCRIPTION OF OTHER EMBODIMENTS

It should be understood by anyone familiar with the art that the quick connect/release coupling could be of a variety of types including but not limited to carabiners, hooks or lanyard connectors as such used in a variety of applications. The body of the cutter could be attached to different, portable holding devices to prevent rotation during the cutting operation. These holding devices could be in the shape of guitars or other instruments and not feature a crank. The cutter body could be mounted to a quick release keychain without a crank as well. A portable holding device could be integrally formed with the cutter body permanently.

The invention claimed is:

1. A tool for facilitating installation and tuning of strings on a stringed instrument which has a turnable button that engages the string, said tool having an elongated socket proportioned to fit over said button and having a lever extending from said socket to facilitate the turning of said button whereby the improvement comprises a quick connector assembly mounted to said tool wherein said quick connector assembly allows said tool to be connected to one of a strap, chain, key ring and necklace to provide ease of use and access.

2. The tool according to claim 1 wherein a handle is mounted to the lever of said tool whereby the improvement comprises a worm-gear string cutter integrally formed with said handle wherein said string cutter comprises a cylindrical body with an axial bore open at one end of said body, said bore having a bottom surface at the opposite end thereof wherein said body has diametrically opposed openings in said body communicating with said bore, both of said openings being enlarged for insertion of a string wherein said bore has a cylindrical cutting stem and a means to selectively advance said stem whereby a string extending between said openings may be severed by advancement of said stem.

3. The apparatus of claim 2 wherein said cylindrical cutting stem has a screw threaded engagement with said axial bore and is advanced and retracted therein by relative rotation therewith, the diameter of said stem providing a close fitting engagement within said bore.

4. The apparatus of claim 2 wherein said stem includes a flat bottom face for engagement with a string, the circular edge thereof providing a cutting edge to sever a string upon advancement of said stem past said opening.

5. The apparatus of claim 2 including means to hold said cylindrical body against rotation during the cutting operation whereby said holding device comprises a rotatable hinge and said hinge has a tongue at one end that couples with a notch in said cylindrical body whereby said rotatable hinge has means at the opposed end to said tongue end to mount said hinge.

* * * * *